United States Patent [19]

Reinke et al.

[11] 3,945,483

[45] Mar. 23, 1976

[54] DEVICE FOR TREATING PRODUCTION PARTS, ESPECIALLY FOR INDUCTIVE HARDENING OF THE PARTS

[75] Inventors: Friedhelm Reinke, Remscheid; Edgar Stengel, Wuppertal-Hahnerberg; Friedhelm Emde, Huckeswagen; Hans Rudolf Schwarz, Remscheid-Luttringhausen, all of Germany

[73] Assignee: AEG-Elotherm, Darmstadt, Germany

[22] Filed: Sept. 18, 1974

[21] Appl. No.: 507,187

[30] Foreign Application Priority Data

Sept. 19, 1973 Germany ..... 2347035

[52] U.S. Cl. ..... 198/21; 198/40; 198/210; 214/1 P; 209/74 R

[51] Int. Cl.[2] ..... B65G 47/42

[58] Field of Search ..... 198/21, 25, 179, 210, 218, 198/39, 40, 211, 209, 107; 209/74 R, 74 M; 148/131; 214/1 P

[56] References Cited

UNITED STATES PATENTS

| | | | |
|---|---|---|---|
| 3,562,030 | 2/1971 | Seulen et al. | 148/131 |
| 3,627,146 | 12/1971 | Berndt | 198/210 |
| 3,662,995 | 5/1972 | Armstrong | 148/131 |

*Primary Examiner*—Robert J. Spar
*Assistant Examiner*—James M. Slattery
*Attorney, Agent, or Firm*—Cushman, Darby & Cushman

[57] ABSTRACT

An apparatus for inductive hardening different types of production parts, such as automobile axles, in a device of the type having a pair of rotatable spiders with a plurality of arms for clamping therebetween the parts for indexing movement from a clamping station to a releasing station, the parts being sequentially presented to the clamping station by a lifting bar conveyor. The type of part presented for clamping and type of part which the arms at the clamping station can clamp are compared and the part only clamped when the types are the same.

3 Claims, 2 Drawing Figures

Figure 1:
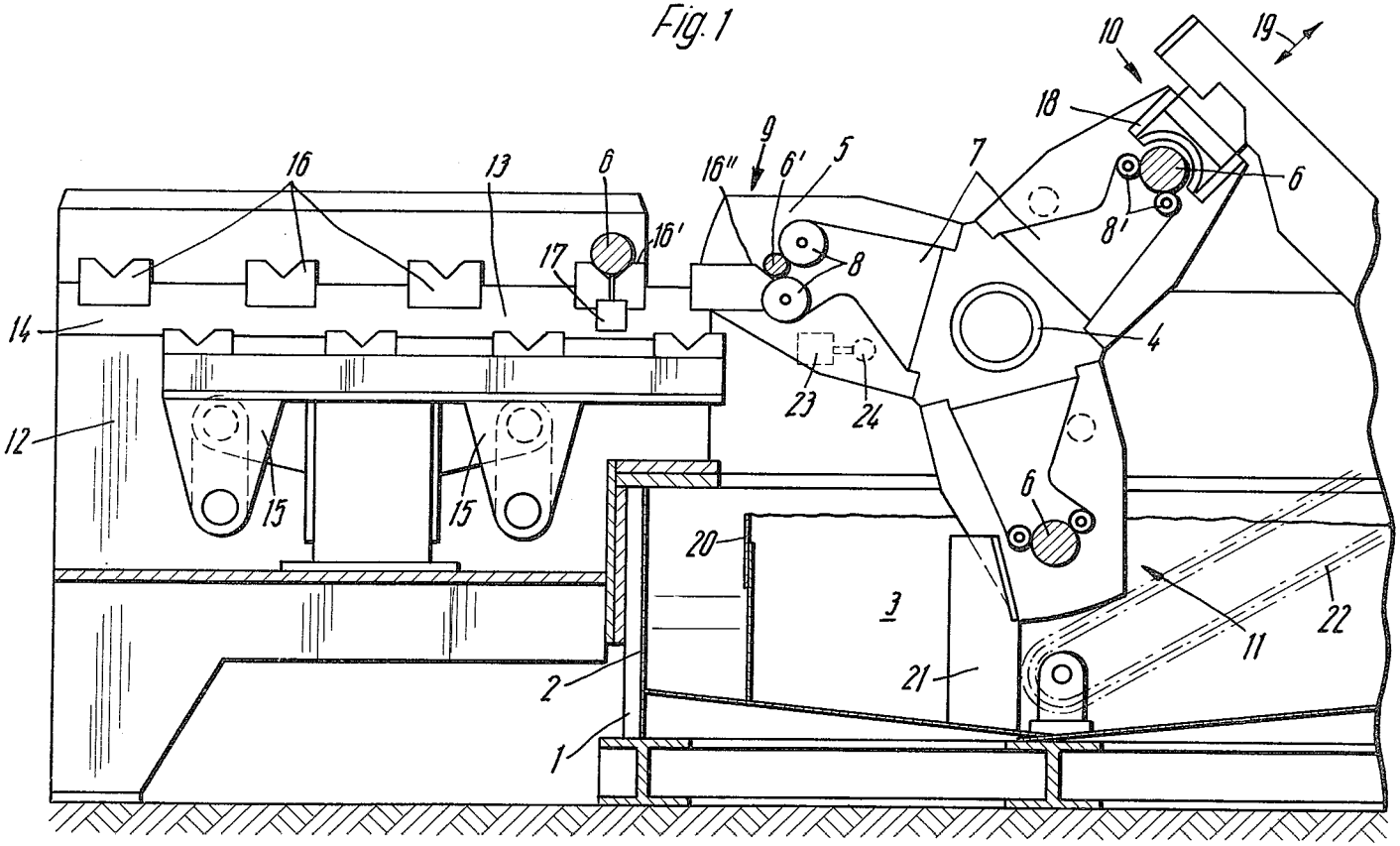

DEVICE FOR TREATING PRODUCTION PARTS, ESPECIALLY FOR INDUCTIVE HARDENING OF THE PARTS

The invention relates to an apparatus for treating, and especially for inductively hardening, production parts having a rotation axis, such as axes, spindles and the like.

This treatment is carried out with a pair of spiders rotating around a given pitch angle. This pair of spiders includes pairs of jib arms with two tail spindles that can be moved toward each other and are used to clamp the parts. These spiders serve for the step-by-step transport of the parts from a clamping point, past one or several treatment points, to an exit point, and, with the help of a production part input device, serve for the step-by-step transport of the parts from an input point, past one or several intermediate points, to a clamping point on the pair of spiders.

Such a device is described in an earlier German Pat. application, P 22 48 053.1. In that patent, it was found to be most advantageous, when handling certain types of production parts of a high fineness ratio, such as axes and axles used in motor vehicle construction, to subject the parts to straightening during inductive hardening. This was preferably done using straightening rolls, that, assigned to a pair of tail spindles were situated in the pair of spiders so that they rotate or can be activated with the same circumferential speed as the adjacent production part surfaces. The straightening rolls can be arranged in such a way that a production part that is to be treated is subjected to a bending stress during clamping (U.S. Pat. No. 3,562,030). For many purposes, it is sufficient if the straightening rolls are mounted on the pair of spiders with a fixed axis, i.e., if the bending stress on a production part is produced by the clamping process. In such a straightening roll arrangement, the construction of the pair of spiders is significantly simplified.

Devices of this type are seldom used, because of their high production part throughput, for the serial manufacture of only a single type of production part, e.g., continuously for the same types of axles of a certain automobile model. Instead, the device is usually used for hardening two or three generally slightly differing types of axles, e.g., with different shaft diameters and/or lengths.

In this case, it is known that for each type of axle — because of the undesirable expenditure of storing the axles along the production line — not too many like parts should be hardened at one time, after which the device must be reset for the next type of axle.

The object of this invention is to provide a device for treating, and above all for inductively hardening, production parts, whereby several different types of parts are conveyed to the device for handling in optional sequence. Resetting time for the device is eliminated, and a place of storage for the different axle types can also largely be eliminated.

This problem is solved by the device of the invention, wherein the pair of spiders have different types of clamping elements, assigned to different types of production parts, on its pair of jib arms. These clamping elements consist of a pair of tail spindles with attached straightening elements. Further, in the last intermediate point of the production part input device, proceeding in the direction of transport, a first testing device is provided to determine the type of production part standing in line and to emit a first kind of testing signal, corresponding to the type of part determined, as well as a second testing device to determine the type of clamping elements standing in line in the clamping station and to emit a second kind of signal corresponding to the type of clamping element detected. Further, a control mechanism controlled by the first and second kinds of signals is provided for the activation of the input device and for the launching of the clamping process on the pair of jib arms standing in line in the clamping station. The input device is preferably formed by a lifting bar conveyor.

Figure 2:
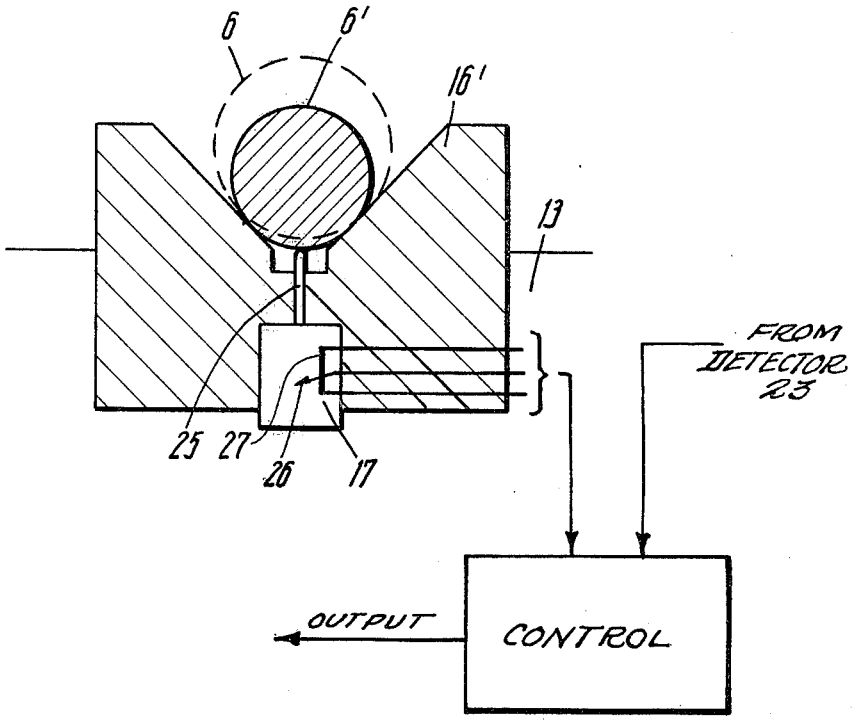

In the following, the invention is described in detail with reference to the drawings, in which:

FIG. 1 shows a partial representation of a device for inductive surface hardening of production parts such as axles, axes and the like, in cross-section; and FIG. 2 shows a detailed cut away view of part of the device of FIG. 1.

The device includes a frame 1, on which a tank 2 for receiving a quenching liquid 3 is mounted. Above the tank 2, in the frame 1, a shaft 4 is fixed so that it rotates. This shaft 4 carries a pair of spiders with 3 pairs of jib arms 5 staggered by 120°. Shaft 4 is conventionally connected to a motor (not shown in the diagram) that produces indexing partial rotations of the pair of spiders of 120°. Each of the pairs of jib arms 5 includes two tail spindles, which, as described in more detail in the German Pat. No. 1,533,953, clamp the production parts 6, and 6' that are to be treated, between their ends. The jib arms 5 also include a pair of straightening rolls 8 attached to a straightening roll support frame 7. This pair of rolls, as described in the U.S. Pat. No. 3,562,030, is so arranged that the treated production part 6 or 6' is subjected to a bending stress during clamping by the pair of straightening rolls 8 that grasp it at about the middle of the length of the part. The pair of straightening rolls 8 are each attached so that they rotate, with axes that are fixed in reference to the production part clamp axes. Rolls 8 are attached to these axes in such a way that a type of production part, characterized by a certain shaft diameter, is assigned to each of the pairs of jib arms 5. The pair of spiders 5 used in the invention described with reference to FIG. 1, is designed with two different production part diameters, and two of the pairs of jib arms are assigned to the larger production part shaft diameter, while the third pair of jib arms is assigned to the smaller shaft diameter. Each of the pairs of jib arms 5 can be moved, by the aforementioned partial rotation of the shaft 4 by 120°, from one clamping station 9 through a conventional heating point 10 to a conventional quenching and releasing point 11. The production parts 6, and 6' are conveyed by a conventional lifting bar conveyor 12, with both a stationary bar system 13 and a lifting bar system 14, which, hinged onto a double crank motion 15, can be subjected to a circular translational motion. The stationary bar system 13 has several production part uptakes 16. In the advancement direction, the last production part uptake 16'' of the stationary bar system 13 is aligned with the production part clamping axis of the pair of jib arms 5 that are at that moment in the clamping station 9.

In the next to the last production part uptake 16' of the stationary bar system 13 in the forward direction of the lifting bar conveyor 12, there is a first testing device 17, which periodically gives off a signal indicating the type of production part waiting in it.

In the heating station 10, a conventional inductor 18 is provided for inductively heating the production parts 6, and 6'. This inductor is part of a unit formed by it and a transformer (not shown) that feeds it in the normal manner. The unit is stationary, but can be shifted in the direction of the arrow 19, so that it can be moved between its operating position as shown in FIG. 1 and a resting position and back again.

In a tank, that is filled with a quenching liquid up to the upper edge of a tray riser 20, a quenching spray nozzle 21 sprays any production part 6 conveyed to the quenching station 11. A chain conveyor 22 removes the parts 6 released in this station 11 from the tank 2. On frame 1 a second testing signal designated as 23 is mounted and is activated by the trip cam 24 of the pair of spiders 5 that happens to be in the clamping station 9, in such a way that the testing device 23 gives off a signal indicating the type of clamping element this pair of spiders 5 bears.

The testing device is explained in greater detail with reference to FIG. 2. A production part 6 or 6' found in the next to the last production part uptake 16' of the stationary bar system, in the forward direction of the lifting bar conveyor 12, moves the axially displaceable tracer 26 of the testing device 17 into a position that indicates the diameter of the production part. The tracer 26 controls the position of the pick-up of a potentiometer designated as 27. The electric signal picked up by the pick-up of the potentiometer is thus dependent upon the diameter of the production part 6 or 6' in the production part depot 16'. The testing device 23 is similar in construction to the testing device 17, except that it is controlled by trip cam 24.

The device works as follows. After the inductive heating of a production part 6 in heating position is over, the inductor 18 is shifted from its heating position to a rest position. There then follows a partial 120° rotation of the pair of spiders, whereby the heated production part is transported to the quenching and releasing station 11 and a new production part 6', clamped in the clamping station 9 and waiting to be heated, is conveyed to the heating station 10.

At the same time that inductor 18 is shifted back to heating position and the inductive heating is performed, the appropriate trip cam 24 of the jib arm pair 5, that is now in the clamping station, releases a signal in the second testing device 23, which signal corresponds to the type of clamping element assigned to this jib arm pair. In a control mechanism indicated as 25 controlled by the signal of testing devices 17 and 23, a signal is producing for launching a clamping process if the adjoining signals of the testing devices correspond, i.e., if the production part that is to be clamped fits the clamping element of the jib arm pair in the clamping station 9.

The clamping process itself, which is not the object of this invention, consists in the automatic conveying of the tail spindles of the jib arm pair 5 in the clamping station 9 to their release position, the subsequent launching of a forward movement of the lifting bar conveyor 12, whereby the production part 6 is conveyed out of the next to the last uptake 16' of the stationary bar system 13 in a forward direction into the last part uptake 16'' that is aligned with the tail spindles in the clamping station 9, and in the subsequent conveying of the tail spindles to their clamping position, whereby the production part 6 or 6' is clamped between the tail spindles. If, upon the forward movement of the lifting bar conveyor 12 taken during the clamping process, upon which movement the part 6 or 6' that is to be clamped is moved from the next to the last uptake 16' to the last uptake 16', another production part moves into the next to the last uptake 16', then further forward movements of the lifting bar conveyor 12 follow immediately until this next to the last uptake 16' is again occupied by another production part 6 or 6' conveyed there by the lifting bar conveyor 12.

When the pair of spiders is in position with the next production 6, which occurs upon a partial rotation of the jib arm pair by 120° in clockwise direction, the production part 6 that is to be clamped and the clamping element in the clamping station 9 fit each other, the clamping process is then performed. Before the end of the inductive heating of the production part in heating position 10, the tail spindles of the pair of spiders in the quenching and releasing station 11 are moved to their releasing position, thereby freeing the production part and placing it on the chain conveyor 22, by which it is transported out of the tank 2 and onward. The operation cycle ends with the end of the inductive heating of the production part 6 that is now in the heating station 10; this end launches the next operation cycle.

If the type of signals given off by the first and second testing device do not agree, then no clamping process is launched, but the simultaneously launched heating of a production part continues, and after the heating is ended, the next operation cycle is launched as described above. This happens until the types of signals of the first and second testing device agree, and during the beginning of the heating of a production part in the heating station, as already described above, the clamping process is performed on the next production part in the appropriate clamping element or straightening element of the pair of spiders 5 in the clamping station 9.

It is thus possible, with the device described, to treat the two different types of production parts — regardless of the sequence in which they are conveyed to the entrance 25 of the lifting bar conveyor — in any optional sequence. Many changes and modifications in the above described embodiment of the invention can of course be carried out without departing from the scope thereof. Accordingly, that scope is intended to be limited only by the scope of the appended claims.

What is claimed is:

1. Apparatus for inductive hardening different types of production parts having axes of rotation comprising:

a pair of rotatable spiders having a plurality of arms for clamping therebetween production parts for indexing movement from a clamping station, through at least one treatment station to a releasing station, said arms being arranged in pairs with each pair clamping one type of part;

means for sequentially presenting workpieces to said clamping stations;

first detecting means for detecting the type of workpiece presented producing a signal indicating that type;

second detecting means for detecting the type of part the pair of arms at said clamping station clamps, and producing a signal indicating that type; and means for causing a presented workpiece to be clamped when the signals from said first and second detecting means indicate the same type and not clamped when the signals indicate different types.

2. Apparatus as in claim 1 wherein said presenting means includes a lifting bar conveyor.

3. Apparatus as in claim 1 wherein said detecting means includes means for producing a signal which varies as a function of the part diameter.

* * * * *